US010598402B2

(12) United States Patent
Arakaki

(10) Patent No.: US 10,598,402 B2
(45) Date of Patent: Mar. 24, 2020

(54) AIR CONDITIONER

(71) Applicant: Mitsubishi Electric Corporation, Tokyo (JP)

(72) Inventor: Yasuto Arakaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/071,612

(22) PCT Filed: Apr. 22, 2016

(86) PCT No.: PCT/JP2016/062848
§ 371 (c)(1),
(2) Date: Jul. 20, 2018

(87) PCT Pub. No.: WO2017/183207
PCT Pub. Date: Oct. 26, 2017

(65) Prior Publication Data

US 2019/0049140 A1 Feb. 14, 2019

(51) Int. Cl.
*F24F 11/89* (2018.01)
*F24F 11/62* (2018.01)
(Continued)

(52) U.S. Cl.
CPC ..... *F24F 11/89* (2018.01); *F24F 11/62* (2018.01); *F24F 2110/10* (2018.01); *F24F 2120/14* (2018.01)

(58) Field of Classification Search
CPC ..... F24F 11/89; F24F 11/62
(Continued)

(56) References Cited

U.S. PATENT DOCUMENTS

2015/0247647 A1* 9/2015 Kusukame ..... H04N 5/33
700/276

FOREIGN PATENT DOCUMENTS

| | | | |
|---|---|---|---|
| JP | 2012-207867 | A | 10/2012 |
| JP | 2013-167425 | A | 8/2013 |
| JP | 2014-112004 | A | 6/2014 |

OTHER PUBLICATIONS

International Search Report of the International Searching Authority dated Jul. 12, 2016 for the corresponding international application No. PCT/JP2016/062848 (and English translation).

* cited by examiner

*Primary Examiner* — Mohammad Ali
*Assistant Examiner* — Joshua T Sanders
(74) *Attorney, Agent, or Firm* — Posz Law Group, PLC

(57) ABSTRACT

An air conditioner includes an infrared camera capturing a thermal image; a living-body detection unit detecting a living body present in an air-conditioning space based on the thermal image; a movement-distance calculation unit that calculates a movement distance of the detected living body; a temperature-control determination unit; a notification unit notifying the detected living body that it is likely to develop heat stroke or hypothermia; and a drive control unit performing the air-conditioning operation. The temperature-control determination unit provides an instruction to perform notification processing when an elapsed time, where the temperature of the detected living body is outside a normal range and the movement distance is less than a threshold value, exceeds a notification time threshold value. The temperature-control determination unit also provides an instruction to perform air-conditioning operation when the elapsed time exceeds a control time threshold value that is greater than the notification time threshold value.

6 Claims, 7 Drawing Sheets

(51) Int. Cl.
*F24F 120/14* (2018.01)
*F24F 110/10* (2018.01)

(58) Field of Classification Search
USPC ..... 700/276
See application file for complete search history.

FIG.3

| DATA | INPUT FROM | OUTPUT TO |
|---|---|---|
| ELAPSED TIME t | TEMPERATURE-CONTROL DETERMINATION UNIT | TEMPERATURE-CONTROL DETERMINATION UNIT |
| LIVING BODY 1 POSITION | LIVING-BODY DETECTION UNIT | MOVEMENT-DISTANCE CALCULATION UNIT |
| LIVING BODY 1 TEMPERATURE | LIVING-BODY DETECTION UNIT | TEMPERATURE-CONTROL DETERMINATION UNIT |
| LIVING BODY 1 PREVIOUS POSITION | MOVEMENT-DISTANCE CALCULATION UNIT | MOVEMENT-DISTANCE CALCULATION UNIT |
| LIVING BODY 1 MOVEMENT DISTANCE | MOVEMENT-DISTANCE CALCULATION UNIT | TEMPERATURE-CONTROL DETERMINATION UNIT |
| ⋮ | | |
| LIVING BODY n POSITION | LIVING-BODY DETECTION UNIT | MOVEMENT-DISTANCE CALCULATION UNIT |
| LIVING BODY n TEMPERATURE | LIVING-BODY DETECTION UNIT | TEMPERATURE-CONTROL DETERMINATION UNIT |
| LIVING BODY n PREVIOUS POSITION | MOVEMENT-DISTANCE CALCULATION UNIT | MOVEMENT-DISTANCE CALCULATION UNIT |
| LIVING BODY n MOVEMENT DISTANCE | MOVEMENT-DISTANCE CALCULATION UNIT | TEMPERATURE-CONTROL DETERMINATION UNIT |

AIR CONDITIONER

CROSS REFERENCE TO RELATED APPLICATION

This application is a U.S. national stage application of International Patent Application No. PCT/JP2016/062848 filed on Apr. 22, 2016, the disclosure of which is incorporated herein by reference.

TECHNICAL FIELD

The present invention relates to an air conditioner that adjusts temperature of air inside a room.

BACKGROUND

Generally, heat stroke is prone to be caused under a high-temperature/humidity environment, while hypothermia is prone to be caused under a low temperature environment. Perception of temperature deteriorates with increasing age, causing delay in response to the heat and cold and thereby easily causing heat stroke and hypothermia.

As more people refrain from turning on air conditioners due to heightened sensitivity to energy conservation, more people tend not to start air conditioners despite elevated room temperature, finally developing heat stroke, and more people tend not to start air conditioners despite lowered room temperature, finally developing hypothermia.

Recently-built houses have heightened airtightness, not readily allowing air into a room even when a window is opened and thus encouraging the trend toward increase in the number of people developing heat stroke. Additionally, some people cannot open windows due to crime prevention reasons, contributing to increase in the number of people developing heat stroke in closed rooms.

In Patent Literature 1, an air conditioner is disclosed that measures temperature in a room and an amount of movement of a person in the room and, if it is determined that heat stroke or hypothermia may be caused, controls the temperature in the room and issues an alert.

PATENT LITERATURE

Patent Literature 1: Japanese Patent Application Laid-open No. 2014-112004

The invention disclosed in Patent Literature 1 may not be able to perform appropriate air-conditioning control when the temperature at an inlet port of the air conditioner is widely different from the temperature of an area where the person in the room is located.

SUMMARY

The present invention has been achieved in view of the above, and an object of the present invention is to provide an air conditioner that can prevent heat stroke or hypothermia regardless of the location of a person in a room.

To solve the problem described above and achieve an object described above, the present invention includes: an imaging unit that captures a thermal image in an air-conditioning space; a living-body detection unit that detects a living body present in the air-conditioning space on a basis of the thermal image; a movement-distance calculation unit that calculates a movement distance of the living body present in the air-conditioning space; and a temperature-control determination unit that provides an instruction to perform notification processing when an elapsed time when the living body whose temperature is outside a normal range where heat stroke and hypothermia are not likely to be caused and whose movement distance is less than a threshold value is present in the air-conditioning space exceeds a notification time threshold value and provides an instruction to perform air-conditioning operation when the elapsed time exceeds a control time threshold value that is greater than the notification time threshold value. The present invention includes: a notification unit that notifies that the living body that is likely to develop heat stroke or hypothermia is present in the air-conditioning space in accordance with the instruction to perform the notification processing; and a drive control unit that performs the air-conditioning operation in accordance with the instruction to perform the air-conditioning operation.

An air conditioner according to the present invention produces an effect of enabling heat stroke or hypothermia to be prevented regardless of the location of a person in a room.

BRIEF DESCRIPTION OF DRAWINGS

FIG. 3 is diagram illustrating example data recorded in a recording medium of the air conditioner according to the first embodiment.

DETAILED DESCRIPTION

An air conditioner according to embodiments of the present invention is described in detail below with reference to the drawings. The present invention is not limited to the embodiments.

First Embodiment

Figure 1:
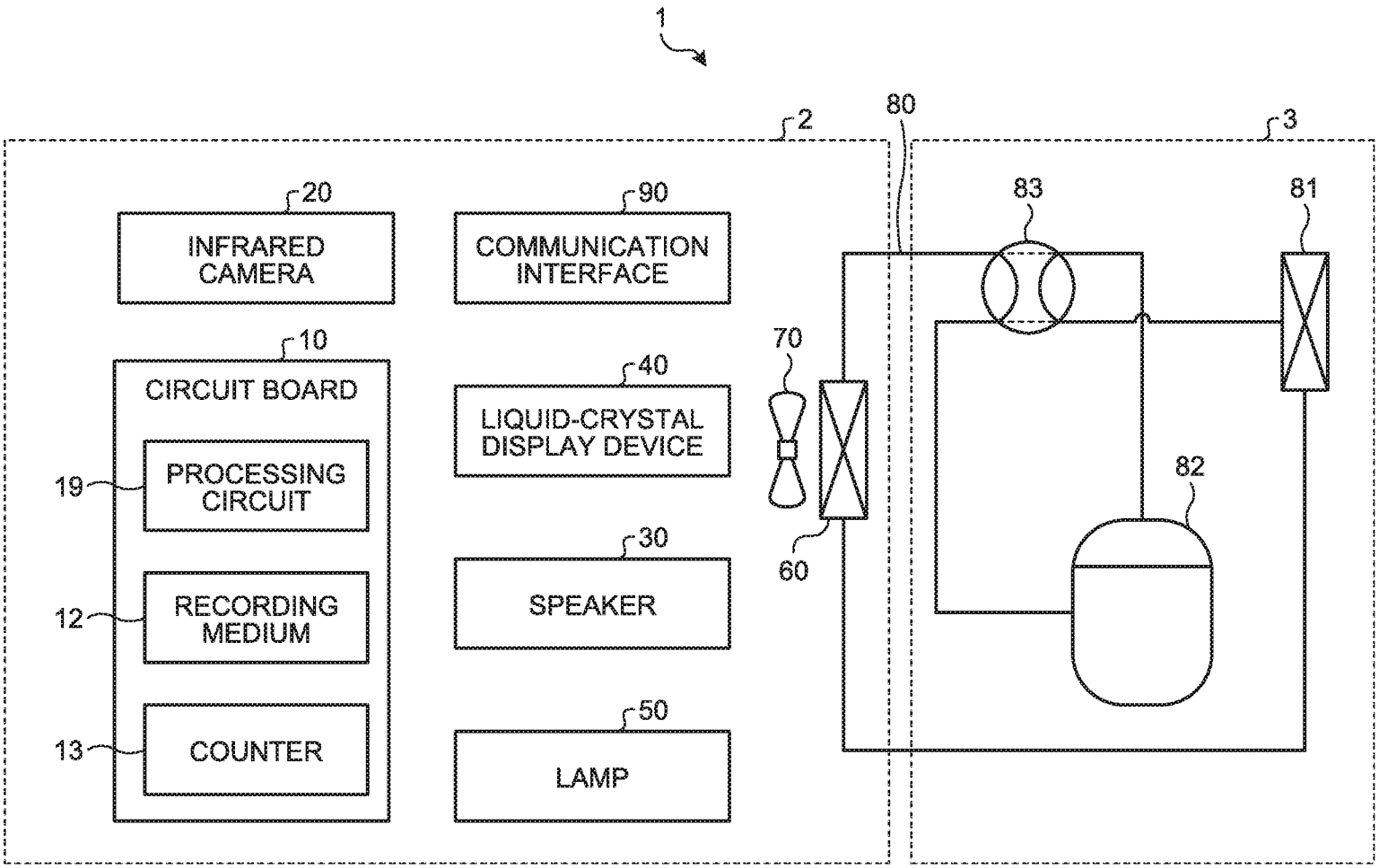
FIG. 1 is a diagram illustrating a configuration of an air conditioner according to a first embodiment of the present invention.

FIG. 1 is a diagram illustrating a configuration of an air conditioner according to a first embodiment of the present invention. An air conditioner 1 according to the first embodiment includes an indoor unit 2 and an outdoor unit 3. The indoor unit 2 includes a circuit board 10 that performs control of air-conditioning operation, an infrared camera 20 that is an imaging unit, a speaker 30 that is a notifying unit by voice, a liquid-crystal display device 40 and a lamp 50 that are notifying units by light, a heat exchanger 60 that allows heat exchange between air inside a room and a refrigerant that flows through a refrigerant circuit 80 during the air-conditioning operation, a fan 70 that forms a flow of air located inside the room so that the flow of the air passes through the heat exchanger 60, and a communication interface 90 for communication with an external communication terminal. The outdoor unit 3 includes a heat exchanger 81 that allows heat exchange between air outside the room and the refrigerant, a compressor 82 that compresses the refrigerant, and a four-way valve 83 that switches direction in which the refrigerant flows.

The circuit board 10 includes a processing circuit 19 that forms a control unit 100 that controls an operation during the air-conditioning operation, a recording medium 12 for recording information for use in the air-conditioning operation, and a counter 13 for measuring a period of time in which a state that may cause heat stroke or hypothermia continues.

Figure 2:
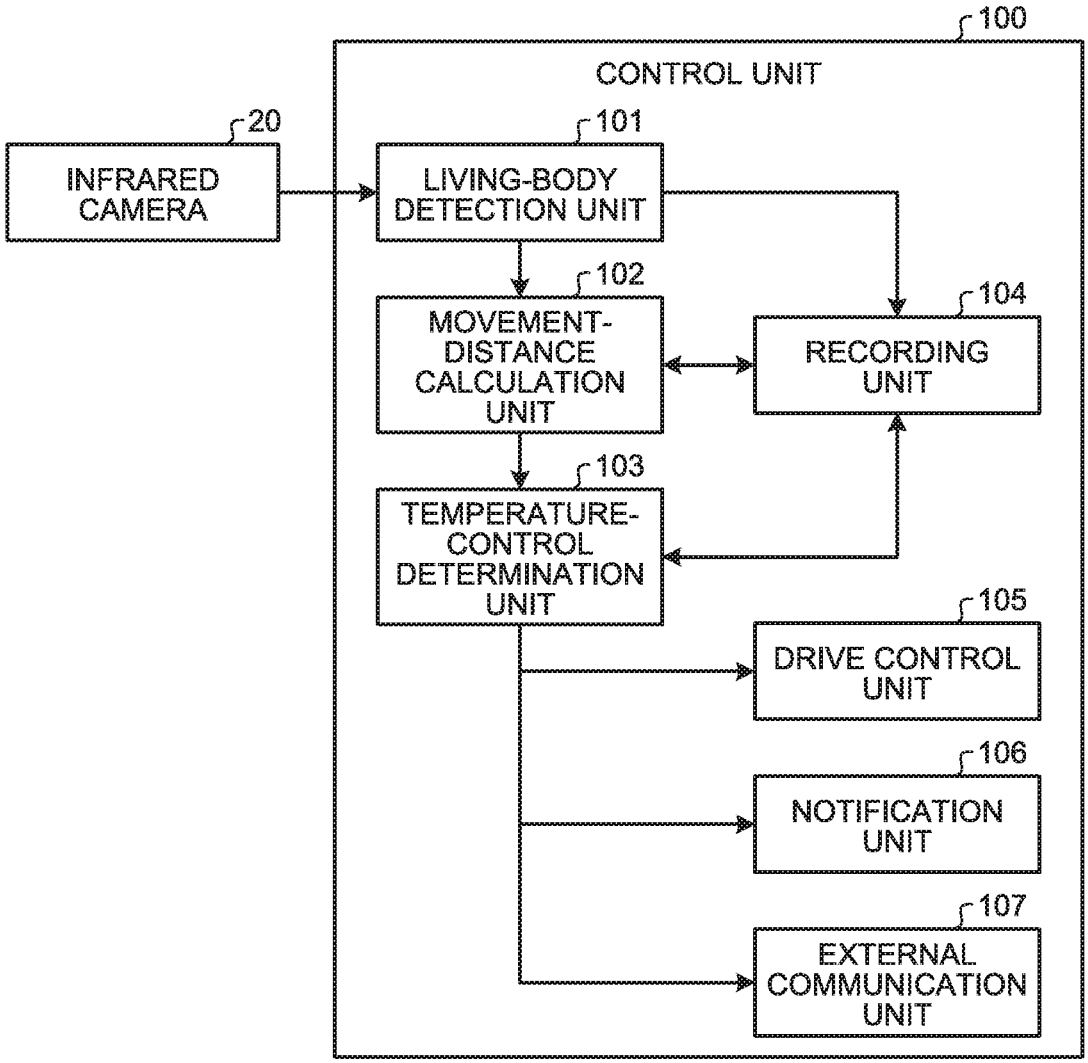
FIG. 2 is a function block diagram of a control unit formed by a processing circuit in the air conditioner according to the first embodiment.

FIG. 2 is a function block diagram of the control unit formed by the processing circuit in the air conditioner according to the first embodiment.

A living-body detection unit 101 detects a position of a living body on the basis of thermal-image information input by the infrared camera 20 at every cycle T and records a detection result in the recording medium 12 via a recording unit 104. The detection result recorded by the living-body detection unit 101 in the recording medium 12 includes a position of a detected living body and temperature of the living body. Detection of a living body may be by a method in which, when a moving heat source in a temperature range from 30° C. to 50° C., which corresponds to living-body temperatures, is detected, the heat source is determined to be a living body. When the living body moves after the detection, the living-body detection unit 101 may determine whether it is the identical living body on the basis of a difference from a thermal image acquired at a previous cycle or on the basis of the area or shape of the heat source. The position of the living body is overwritten in the recording medium 12 at every cycle.

A movement-distance calculation unit 102 estimates that living bodies having the least difference in position are an identical living body on the basis of positions of living bodies input by the living-body detection unit 101 and previous positions of living bodies stored in the recording medium 12. The movement-distance calculation unit 102 records a movement distance that is a difference in position in the recording medium 12 via the recording unit 104.

A temperature-control determination unit 103 executes temperature control determination on the basis of the temperature of the identical living body and the movement distance, which are recorded in the recording medium 12, and outputs an execution result to a drive control unit 105. The temperature-control determination unit 103 also records an elapsed time t measured using the counter 13 in the recording medium 12 via the recording unit 104. Since the thermal-image information of the infrared camera 20 is acquired at every cycle T, the temperature-control determination unit 103 calculates the elapsed time t by incrementing a value n of the counter 13 using the elapsed time $t=n\times T$.

The recording unit 104 performs data read/write processing in the recording medium 12. The recording medium 12 is a nonvolatile recording element or a volatile recording element that records the elapsed time t. FIG. 3 is diagram illustrating example data recorded in the recording medium of the air conditioner according to the first embodiment. In FIG. 3, the leftmost column represents data, the second column from the left represents an input source that records data, and the rightmost column represents an output target that reads the data. That is, data "living body 1 position" is recorded by the living-body detection unit 101 in the recording medium 12 via the recording unit 104 and read by the movement-distance calculation unit 102 from the recording medium 12 via the recording unit 104.

The drive control unit 105 performs motor control for the compressor 82 to adjust temperature of the refrigerant circuit 80 and fan rotation control for the fan 70 to adjust an amount of air delivery, thereby achieving air conditioning provided by general air conditioners.

When the temperature-control determination unit 103 determines that heat stroke or hypothermia is highly likely to be caused, a notification unit 106 notifies a user in the room by emitting a sound from or displaying a message on the air conditioner. The lamp 50 or the liquid-crystal display device 40 can be used for displaying a message. The speaker 30 can be used for emitting a sound.

When the temperature-control determination unit 103 determines that heat stroke or hypothermia is highly likely to be caused, an external communication unit 107, similarly to the notification unit 106, notifies a predefined external communication terminal using the communication interface 90, which may be a wireless local area network (LAN) router or a wired LAN router, via a communication network that an environment in which the air conditioner is installed may be detrimental to health.

Figure 4:
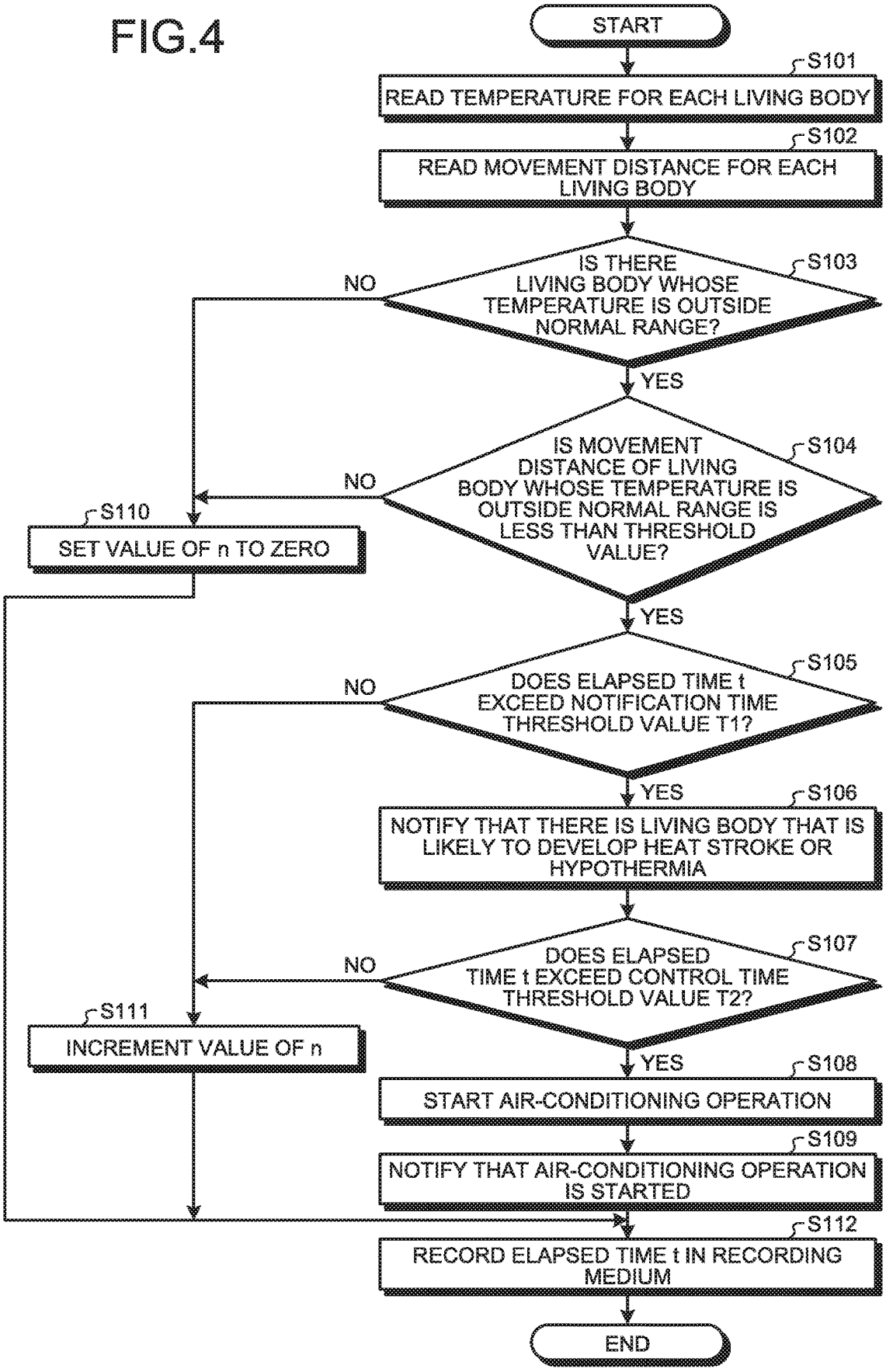
FIG. 4 is a flowchart illustrating a flow of an operation of the air conditioner according to the first embodiment.

An operation of the air conditioner according to the first embodiment is described next. FIG. 4 is a flowchart illustrating a flow of an operation of the air conditioner according to the first embodiment. The letter t represents an elapsed time during which there is a risk of causing heat stroke or hypothermia and can be calculated with the elapsed time $t=n\times T$, using the value n of the counter 13 and the cycle T at which the thermal-image information is acquired from the infrared camera 20. The value n of the counter 13 is zero when the air conditioner is started. The temperature-control determination unit 103 reads in step S101 via the recording unit 104 a temperature for each living body recorded in the recording medium 12.

The temperature-control determination unit 103 reads in step S102 via the recording unit 104 a movement distance for each living body recorded in the recording medium 12.

The temperature-control determination unit 103 determines in step S103 whether or not there is a living body whose temperature that is read in step S101 is outside a normal range in which heat stroke or hypothermia is not likely to be caused. If there is no living body whose temperature that is read in step S101 is outside the normal range, No is selected in step S103 and the flowchart proceeds to step S110. If there is a living body whose temperature that is read in step S101 is outside the normal range, Yes is selected in step S103 and, the temperature-control determination unit 103 determines in step S104 whether or not a movement distance of the living body whose temperature is outside the normal range is less than a threshold value. The threshold value used here is recorded in the recording medium 12 in advance on the basis of an amount of movement exhibited when a living body can make a self-recovery of physical condition.

If the movement distance of the living body whose temperature is outside the normal range is less than the threshold value, Yes is selected in step S104 and the flowchart proceeds to step S105. If the movement distance of the living body whose temperature is outside the normal range is equal to or more than the threshold value, No is selected in step S104 and the flowchart proceeds to step S110.

The temperature-control determination unit 103 determines in step S105 whether the elapsed time t during which the living body whose temperature is outside the normal range and whose movement distance is less than the threshold value is present exceeds a notification time threshold value T1. If the elapsed time t does not exceed the notification time threshold value T1, No is selected in step S105 and the flowchart proceeds to step S111. If the elapsed time t exceeds the notification time threshold value T1, Yes is selected in step S105 and the flowchart proceeds to step S106.

The temperature-control determination unit 103 performs in step S106 processing to notify that there is a living body that is likely to develop heat stroke or hypothermia. The temperature-control determination unit 103 causes the notification unit 106 to notify a person located near the air conditioner using at least one of the speaker 30, the liquid-crystal display device 40, and the lamp 50 that a remedy is necessary for the living body that is likely to develop heat stroke or hypothermia. That is, the temperature-control determination unit 103 instructs the notification unit 106 to perform notification processing, and the notification unit 106 notifies that a living body that is likely to develop heat stroke or hypothermia is present in an air-conditioning space in accordance with the instruction to perform the notification processing. The temperature-control determination unit 103 also causes the external communication unit 107 to notify the external communication terminal that a remedy for heat stroke or hypothermia is necessary in the room in which the air conditioner is installed. That is, the temperature-control determination unit 103 instructs the external communication unit 107 to perform the notification processing, and the external communication unit 107 notifies the external communication terminal that a living body that is likely to develop heat stroke or hypothermia is present in the air-conditioning space in accordance with the instruction to perform the notification processing.

As a method of notification by the notification unit 106, a method in which the speaker 30 emits a buzzer sound, a method in which the lamp 50 flashes or is turned on, or a method in which the liquid-crystal display device 40 displays a message that an abnormal temperature is detected can be used. The method of notification by the notification unit 106 is not limited to those described above.

The temperature-control determination unit 103 determines in step S107 whether the elapsed time t exceeds a control time threshold value T2. The control time threshold value T2 and the notification time threshold value T1 satisfies a relationship of $T1<T2$. If the elapsed time t does not exceed the control time threshold value T2, No is selected in step S107 and the flowchart proceeds to step S111. If the elapsed time t exceeds the control time threshold value T2, Yes is selected in step S107 and the flowchart proceeds to step S108.

The temperature-control determination unit 103 transmits in step S108 an instruction to the drive control unit 105 to start the air-conditioning operation. That is, the temperature-control determination unit 103 instructs the drive control unit 105 to perform the air-conditioning operation, and the drive control unit 105 performs the air-conditioning operation in accordance with the instruction to perform the air-conditioning operation. If the air-conditioning operation has been already started, the temperature-control determination unit 103 continues the air-conditioning operation. The temperature-control determination unit 103 keeps performing the air-conditioning operation until a room temperature reaches a control target temperature at which there is no risk of causing heat stroke or hypothermia. If the air conditioner is in a nonoperational state and Yes is selected in step S107, the drive control unit 105 forces the air conditioner to switch to an operational state. While the control target temperature is 22° C. in the first embodiment, it is not limited to this temperature. The control target temperature may be settable by a user.

The temperature-control determination unit 103 notifies in step S109 the predefined external communication terminal via the external communication unit 107 that the air-conditioning operation is started due to a risk of heat stroke or hypothermia. A person outside a room can be notified of the condition inside the room, even if a person in the room cannot move, by notifying the external communication terminal that the air-conditioning operation is started, thereby a remedy against heat stroke or hypothermia can be provided.

The temperature-control determination unit 103 sets in step S110 the value n of the counter 13 to zero to thereby reset the elapsed time t. The processing in step S110 is performed when there is no living body that has a risk of developing heat stroke or hypothermia, or when a living body that has a risk of developing heat stroke or hypothermia is in a state in which the living body can start the air-conditioning operation by itself.

The temperature-control determination unit 103 increments in step S111 the value n of the counter 13 to thereby continue measuring the elapsed time t. When the temperature-control determination unit 103 increments the value n of the counter 13, the elapsed time t becomes $(n+1)\times T$, becoming an elapsed time at which the thermal-image information is acquired at a subsequent cycle. The processing in step S111 is performed when it is determined that the elapsed time t does not exceed the notification time threshold value T1 or when it is determined that the elapsed time t does not exceed the control time threshold value T2.

The temperature-control determination unit 103 records in step S112 the elapsed time t in the recording medium 12 via the recording unit 104.

As described above, the air conditioner according to the first embodiment measures temperature of a living body, thus being capable of facilitating improvement of an environment in a room by making notification if heat stroke or hypothermia is likely to be caused. Additionally, the air conditioner according to the first embodiment starts the air-conditioning operation automatically if a state continues in which a living body that is likely to develop heat stroke or hypothermia is present, thus being capable of preventing heat stroke or hypothermia to be caused while the living body is in sleep and thus unaware of the notification. Additionally, the air conditioner according to the first embodiment starts the air-conditioning operation automatically if the state continues in which a living body that is likely to develop heat stroke or hypothermia is present, and thus is capable of preventing heat stroke or hypothermia to be caused if the living body in the room is a pet that cannot operate the air conditioner.

Moreover, the air conditioner according to the first embodiment measures a movement distance in addition to temperature of a living body, thus being capable of forcing the air-conditioning operation not to start if the body temperature is outside the normal range temporarily due to special circumstances, such as immediately after an exercise or after the bath, and the movement distance is equal to or greater than a threshold value.

Second Embodiment

Figure 5:
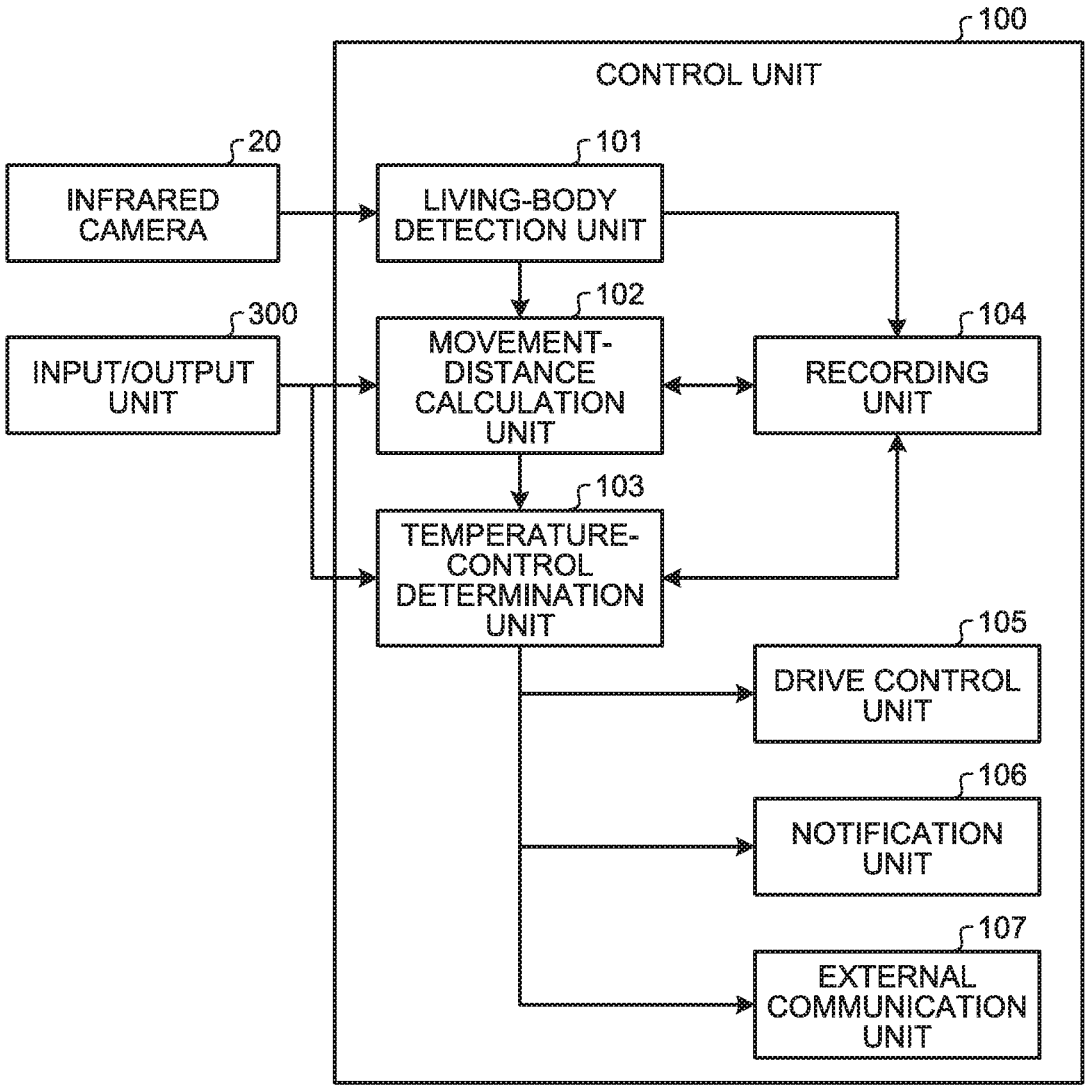
FIG. 5 is a function block diagram of a control unit formed by a processing circuit in an air conditioner according to a second embodiment of the present invention.

FIG. 5 is a function block diagram of the control unit formed by the processing circuit in an air conditioner according to a second embodiment of the present invention. The air conditioner is different from the air conditioner according to the first embodiment in that an input/output unit 300 is included. The input/output unit 300 is a remote controller, a touch panel, or a switch of the air conditioner. In the second embodiment, a threshold value for use in determination of a movement distance of a living body and a normal range of temperature of the living body are selectable by an operation on the input/output unit 300.

The air conditioner according to the second embodiment allows a user to select a mode via the input/output unit 300. The temperature-control determination unit 103 determines a threshold value for use in the determination of a movement distance performed in step S104 in accordance with the mode set via the input/output unit 300.

The air conditioner according to the second embodiment may be settable to allow the temperature-control determination unit 103 to always determine Yes in step S104 using "none" for the threshold value for use in the determination of the movement distance of a living body.

The normal range of temperature of a living body is set by an operation on the input/output unit 300. An average temperature is set via the input/output unit 300, with the average temperature+$\alpha$ set to be an upper-limit threshold value and the average temperature−$\alpha$ set to be a lower-limit threshold value. The upper-limit threshold value and the lower-limit threshold value may be set directly via the input/output unit 300.

As described above, the air conditioner according to the second embodiment allows a threshold value for use by the temperature control determination unit 103 in determination of a movement distance of a living body and a normal range of temperature of a living body to be selected by an operation on the input/output unit 300, thereby being capable of preventing heat stroke and hypothermia when an elderly person whose movement distance is short or a pet whose movement distance is long is present in a room.

Third Embodiment

In the first and second embodiments, notification is started when the elapsed time since temperature of a living body is deviated from a normal range exceeds the notification time threshold value T1, and temperature control is started when the elapsed time exceeds the control time threshold value T2. The air conditioner according to the first and second embodiments, however, may be prevented from being supplied with power when the notification is provided or when the temperature control is started, if a person in the room does not wish to allow the air conditioner to be operated.

Providing the notification or starting the temperature control regardless of the will of a user may lead to a potential complaint about an unsolicited operation of the air conditioner.

An air conditioner according to a third embodiment of the present invention is thus configured to operate in such a manner that a user is not likely to notice the operation of the air conditioner, while preventing heat stroke and hypothermia. A difference from the first embodiment only is described below.

The control unit configured using the processing circuit of the air conditioner according to the third embodiment is similar to that of the air conditioner according to the second embodiment illustrated in FIG. 5 and includes the input/output unit 300. The input/output unit 300 according to the third embodiment is a unit that sets a mode that is different from a normal mode and performs the air-conditioning control automatically in such a manner that a user is not likely to notice the operation. The mode different from the normal mode is referred to as stealth mode below. That is, the air conditioner according to the third embodiment can be set to the stealth mode.

Figure 6:
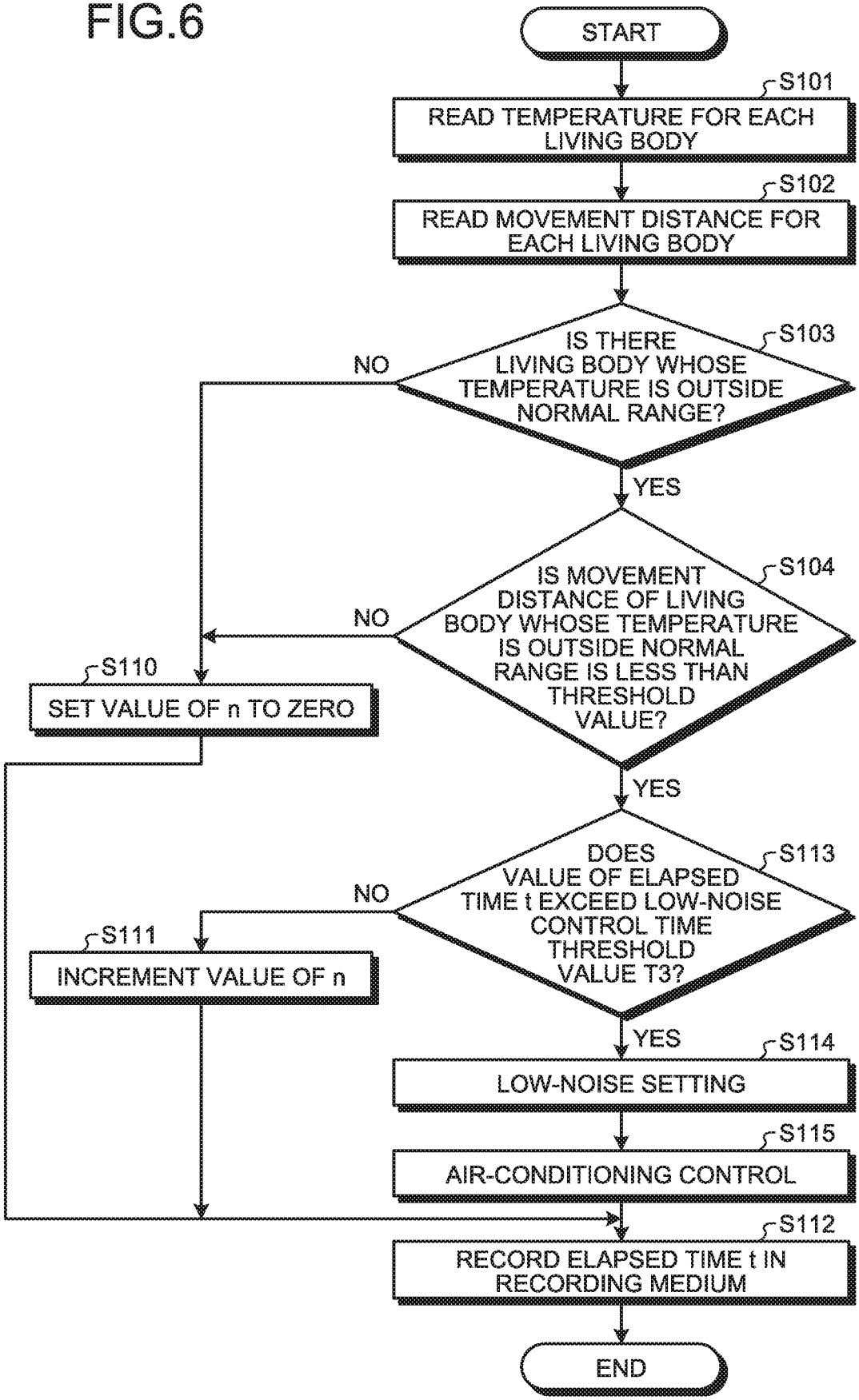
FIG. 6 is a flowchart illustrating a flow of an operation in a stealth mode of an air conditioner according to a third embodiment.

FIG. 6 is a flowchart illustrating a flow of an operation in the stealth mode of the air conditioner according to the third embodiment. Processing up to step S104 and processing in step S110 are similar to those of the air conditioner according to the first embodiment illustrated in FIG. 4. The temperature-control determination unit 103 determines in step S113 whether or not the elapsed time t exceeds a low-noise control time threshold value T3. The low-noise control time threshold value T3 may be equal to the notification time threshold value T1 or may be defined independently from the notification time threshold value T1.

If the elapsed time t exceeds the low-noise control time threshold value T3, Yes is selected in step S113, and the temperature-control determination unit 103 performs low-noise setting in step S114. In the low-noise setting, the number of revolutions of the fan is set to a low speed so that unpleasant wind and noise is not caused for a user. Additionally, a control target value of the air-conditioning control is set to somewhat higher than the upper-limit threshold value if a temperature subject to the control is higher than the upper-limit threshold value, and set to somewhat lower than the lower-limit threshold value if the temperature subject to the control is equal to or lower than the lower-limit threshold value. An operation starting sound and operation display light emitted from the speaker 30, the liquid-crystal display device 40, and the lamp 50 during an operation in the normal mode are inhibited.

If the elapsed time t does not exceed the low-noise control time threshold value T3, No is selected in step S113 and the flowchart proceeds to step S111. Processing in step S111 and step S112 is similar to that in the first embodiment.

The temperature-control determination unit 103 performs in step S115 the air-conditioning control on the basis of the condition set in step S114 and causes the temperature in the room to gradually approach the control target value.

As described above, when set to the stealth mode, the air conditioner according to the third embodiment performs the air-conditioning operation in such a manner not readily discernable from the nonoperational state, and thereby curbing divergence of a room temperature exhibited after the air-conditioning control from that in the nonoperational state. That is, when set to the stealth mode, the air conditioner according to the third embodiment performs the air-conditioning operation with the number of revolutions of the fan reduced and the operation starting sound and the operation display light emitted from the speaker 30, the liquid-crystal display device 40, and the lamp 50 inhibited. The air conditioner according to the third embodiment can thus inhibit a user complaint about an unsolicited operation of the air conditioner and prevent heat stroke or hypothermia from being caused due to the user stopping the air-conditioning operation at the discretion of the user.

A function of the control unit 100 is achieved using the processing circuit 19 in the first to third embodiments described above. That is, the air conditioner includes the processing circuit 19, which performs the processing to detect a position of a living body on the basis of thermal-image information input by the infrared camera 20 at every cycle T and record a detection result in the recording medium 12 via the recording unit 104, the processing to estimate that living bodies having the least difference in position are an identical living body on the basis of positions of living bodies input by the living-body detection unit 101 and previous positions of living bodies stored in the recording medium 12, the processing to execute the temperature control determination on the basis of the temperature of the identical living body and the movement distance, which are recorded in the recording medium 12, and output an execution result to the drive control unit 105, and also record an elapsed time t measured using the counter 13 in the recording medium 12 via the recording unit 104. The processing circuit 19 performs the data read/write processing in the recording medium 12, the processing to perform the motor control for the compressor 82 to adjust temperature of the refrigerant circuit 80 and the fan rotation control for the fan 70 to adjust an amount of air delivery, thereby achieving air conditioning provided by general air conditioners, the processing to, when the temperature-control determination unit 103 determines that heat stroke or hypothermia is highly likely to be caused, notify a user in the room by emitting a sound from or displaying a message on the air conditioner, and the processing to, when the temperature-control determination unit 103 determines that heat stroke or hypothermia is highly likely to be caused, notify a predefined external communication terminal using the communication interface 90 via a communication network that an environment in which the air conditioner is installed may be detrimental to health. The processing circuit may be dedicated hardware or an arithmetic unit that executes a program stored in a storage device.

Figure 7:
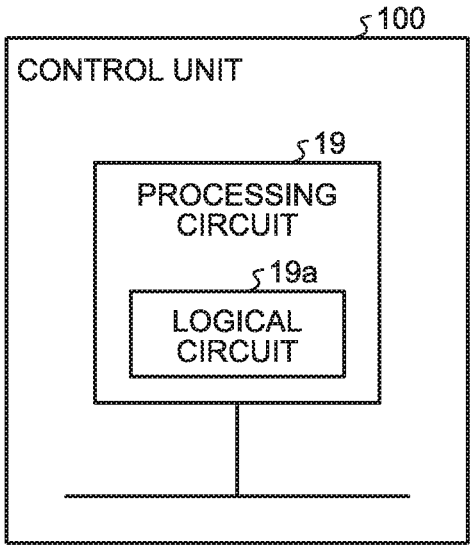
FIG. 7 is a diagram illustrating a configuration in which a function of the control unit of the air conditioner according to the first to third embodiments is achieved using hardware.

When the processing circuit 19 is dedicated hardware, the processing circuit 19 may be a single circuit, a compound circuit, a programmed processor, a parallel programmed processor, an integrated circuit for use in particular applications, a field programmable gate array, or a combination of them. FIG. 7 is a diagram illustrating a configuration in which a function of the control unit of the air conditioner according to the first to third embodiments is achieved using hardware. The processing circuit 19 includes a logical circuit 19*a* that achieves the processing to detect a position of a living body on the basis of thermal-image information input by the infrared camera 20 at every cycle T and record a detection result in the recording medium 12 via the recording unit 104, the processing to estimate that living bodies having the least difference in position are an identical living body on the basis of positions of living bodies input by the living-body detection unit 101 and previous positions of living bodies stored in the recording medium 12, the processing to execute the temperature control determination on the basis of the temperature of the identical living body and the movement distance, which are recorded in the recording medium 12, and output an execution result to the drive control unit 105, and also record an elapsed time t measured using the counter 13 in the recording medium 12 via the recording unit 104. The logical circuit 19*a* performs the data read/write processing in the recording medium 12, the processing to perform the motor control for the compressor 82 to adjust temperature of the refrigerant circuit 80 and the fan rotation control for the fan 70 to adjust an amount of air delivery, thereby achieving air conditioning provided by general air conditioners, the processing to, when the temperature-control determination unit 103 determines that heat stroke or hypothermia is highly likely to be caused, notify a user in the room by emitting a sound from or displaying a message on the air conditioner, and the processing to, when the temperature-control determination unit 103 determines that heat stroke or hypothermia is highly likely to be caused, notify a predefined external communication terminal using the communication interface 90 via a communication network that an environment in which the air conditioner is installed may be detrimental to health. Each processing described above may be achieved using a different processing circuit.

When the processing circuit 19 is an arithmetic unit, the processing to detect a position of a living body on the basis of thermal-image information input by the infrared camera 20 at every cycle T and record a detection result in the recording medium 12 via the recording unit 104, the processing to estimate that living bodies having the least difference in position are an identical living body on the basis of positions of living bodies input by the living-body detection unit 101 and previous positions of living bodies stored in the recording medium 12, the processing to execute the temperature control determination on the basis of the temperature of the identical living body and the movement distance, which are recorded in the recording medium 12, and output an execution result to the drive control unit 105, and also record an elapsed time t measured using the counter 13 in the recording medium 12 via the recording unit 104 are achieved using software, firmware, or a combination of software and firmware. When the processing circuit 19 is the arithmetic unit, the data read/write processing in the recording medium 12, the processing to perform the motor control for the compressor 82 to adjust temperature of the refrigerant circuit 80 and the fan rotation control for the fan 70 to adjust an amount of air delivery, thereby achieving air conditioning provided by general air conditioners, the processing to, when the temperature-control determination unit 103 determines that heat stroke or hypothermia is highly likely to be caused, notify a user in the room by emitting a sound from or displaying a message on the air conditioner, and the processing to, when the temperature-control determination unit 103 determines that heat stroke or hypothermia is highly likely to be caused, notify a predefined external communication terminal using the communication interface 90 via a communication network that an environment in which the air conditioner is installed may be detrimental to health are also achieved similarly using software, firmware, or a combination of software and firmware.

Figure 8:
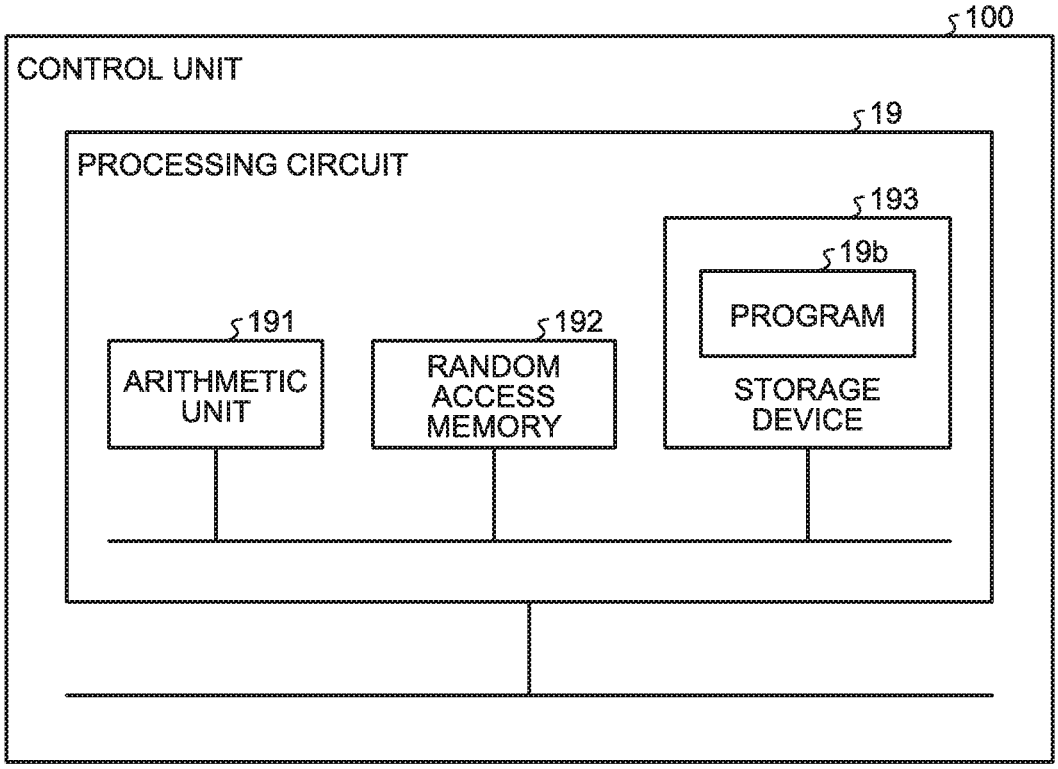
FIG. 8 is a diagram illustrating a configuration in which the function of the control unit of the air conditioner according to the first to third embodiments is achieved using software.

FIG. 8 is a diagram illustrating a configuration in which the function of the control unit of the air conditioner according to the first to third embodiments is achieved using software. The processing circuit 19 includes an arithmetic unit 191 that executes a program 19*b*, a random access memory 192 that the arithmetic unit 191 uses as a work area, and a storage device 193 that stores the program 19*b*. By the arithmetic unit 191 loading the program 19*b*, which is stored in the storage device 193, onto the random access memory 192 and executing the program 19*b*, the processing to detect a position of a living body on the basis of thermal-image information input by the infrared camera 20 at every cycle T and record a detection result in the recording medium 12 via the recording unit 104, the processing to estimate that living bodies having the least difference in position are an identical living body on the basis of positions of living bodies input by the living-body detection unit 101 and previous positions of living bodies stored in the recording medium 12, the processing to execute the temperature control determination on the basis of the temperature of the identical living body and the movement distance, which are recorded in the recording medium 12, and output an execution result to the drive control unit 105, and also record an elapsed time t measured using the counter 13 in the recording medium 12 via the recording unit 104 are achieved using software, firmware, or a combination of software and firmware.

The data read/write processing in the recording medium 12, the processing to perform the motor control for the compressor 82 to adjust temperature of the refrigerant circuit 80 and the fan rotation control for the fan 70 to adjust an amount of air delivery, thereby achieving air conditioning provided by general air conditioners, the processing to, when the temperature-control determination unit 103 determines that heat stroke or hypothermia is highly likely to be caused, notify a user in the room by emitting a sound from or displaying a message on the air conditioner, and the processing to, when the temperature-control determination unit 103 determines that heat stroke or hypothermia is highly likely to be caused, notify a predefined external communication terminal using the communication interface 90 via a communication network that an environment in which the air conditioner is installed may be detrimental to health are also achieved similarly by the arithmetic unit 191 loading the program 19*b*, which is stored in the storage device 193, onto the random access memory 192 and executing the program 19*b*. The software or firmware is described in a program language and stored in the storage device 193.

The processing circuit 19 achieves a function of the control unit 100 by reading and executing the program 19*b*, which is stored in the storage device 193. That is, the control unit 100 includes the storage device 193 for storing the program 19*b* that, when executed by the processing circuit 19, results in execution of a step of detecting a position of a living body on the basis of thermal-image information input by the infrared camera 20 at every cycle T and recording a detection result in the recording medium 12 via the recording unit 104, a step of estimating that living bodies having the least difference in position are an identical living body on the basis of positions of living bodies input by the living-body detection unit 101 and previous positions of living bodies stored in the recording medium 12, a step of executing the temperature control determination on the basis of the temperature of the identical living body and the movement distance, which are recorded in the recording medium 12, and outputting an execution result to the drive control unit 105, and also recording an elapsed time t measured using the counter 13 in the recording medium 12 via the recording unit 104. The program 19*b* that, when executed by the processing circuit 19, results in execution of a step of reading/writing data in the recording medium 12, a step of performing the motor control for the compressor 82 to adjust temperature of the refrigerant circuit 80 and the fan rotation control for the fan 70 to adjust an amount of air delivery, thereby achieving air conditioning provided by general air conditioners, a step of, when the temperature-control determination unit 103 determines that heat stroke or hypothermia is highly likely to be caused, notifying a user in the room by emitting a sound from or displaying a message on the air conditioner, and a step of, when the temperature-control determination unit 103 determines that heat stroke or hypothermia is highly likely to be caused, notifying a predefined external communication terminal using the communication interface 90 via a communication network that an environment in which the air conditioner is installed may be detrimental to health can be also stored in the storage device 193. It can be also said that the program 19*b* causes a computer to execute the procedure and the method described above.

A part of functions of the control unit 100 may be achieved using dedicated hardware and another part may be achieved using software or firmware.

As described above, the processing circuit 19 can achieve each of the functions described above using hardware, software, firmware, or a combination of them.

The configurations in the embodiments described above represent some examples of the present invention, and they can be combined with another publicly known technique and partially omitted or modified without departing from the spirit of the present invention.

The invention claimed is:

1. An air conditioner, comprising:

an image sensor to capture a thermal image in an air-conditioning space;

a living-body detector to detect a living body present in the air-conditioning space on a basis of the thermal image;

a movement-distance calculator to calculate a movement distance of the living body present in the air-conditioning space;

a temperature-control determinator to provide an instruction to perform notification processing when an elapsed time when the living body whose temperature is outside a normal range where heat stroke and hypothermia are not likely to be caused and whose movement distance is less than a threshold value is present in the air-conditioning space exceeds a notification time threshold value and to provide an instruction to perform air-conditioning operation when the elapsed time exceeds a control time threshold value that is greater than the notification time threshold value;

a notifier to notify that the living body that is likely to develop heat stroke or hypothermia is present in the air-conditioning space in accordance with the instruction to perform the notification processing; and a drive controller to perform the air-conditioning operation in accordance with the instruction to perform the air-conditioning operation.

2. The air conditioner according to claim 1, further comprising an external communicator to notify an external communication terminal that the living body that is likely to develop heat stroke or hypothermia is present in the air-conditioning space in accordance with the instruction to perform the notification processing.

3. The air conditioner according to claim 1, further comprising an input/output device to allow a threshold value for the movement distance and a higher-temperature threshold value and a lower-temperature threshold value of the normal range to be set.

4. The air conditioner according to claim 1, further comprising a receiver to receive an operation in a mode different from a normal mode, wherein, when the mode different from the normal mode is set and the elapsed time exceeds a low-noise control time threshold value, the temperature-control determinator instructs the drive controller to perform an air-conditioning control operation until a room temperature achieves a target temperature that is not likely to cause heat stroke and hypothermia while the temperature-control determinator inhibits a sound and light emitted during an operation.

5. The air conditioner according to claim 2, further comprising a receiver to receive an operation in a mode different from a normal mode, wherein, when the mode different from the normal mode is set and the elapsed time exceeds a low-noise control time threshold value, the temperature-control determinator instructs the drive controller to perform an air-conditioning control operation until a room temperature achieves a target temperature that is not likely to cause heat stroke and hypothermia while the temperature-control determinator inhibits a sound and light emitted during an operation.

6. The air conditioner according to claim 3, further comprising a receiver to receive an operation in a mode different from a normal mode, wherein, when the mode different from the normal mode is set and the elapsed time exceeds a low-noise control time threshold value, the temperature-control determinator instructs the drive controller to perform an air-conditioning control operation until a room temperature achieves a target temperature that is not likely to cause heat stroke and hypothermia while the temperature-control determinator inhibits a sound and light emitted during an operation.

* * * * *